US007652630B2

(12) United States Patent
Rosenberger et al.

(10) Patent No.: US 7,652,630 B2
(45) Date of Patent: Jan. 26, 2010

(54) MOTOR VEHICLE ROOF ANTENNA

(75) Inventors: Bernd Rosenberger, Tittmoning (DE); Jens-Peter Freundt, Kaltenkirchen (DE); Willem Blakborn, Inzell (DE); Christian Floren, Hildesheim (DE)

(73) Assignee: Rosenberger Hochfrequenztechnik GmbH & Co. KG, Munich (DE)

( * ) Notice: Subject to any disclaimer, the term of this patent is extended or adjusted under 35 U.S.C. 154(b) by 71 days.

(21) Appl. No.: 11/908,991

(22) PCT Filed: Mar. 21, 2006

(86) PCT No.: PCT/EP2006/002574

§ 371 (c)(1),
(2), (4) Date: May 12, 2008

(87) PCT Pub. No.: WO2006/100034

PCT Pub. Date: Sep. 28, 2006

(65) Prior Publication Data

US 2009/0040121 A1 Feb. 12, 2009

(30) Foreign Application Priority Data

Mar. 22, 2005 (DE) ..... 20 2005 004 658 U

(51) Int. Cl.
*H01Q 1/32* (2006.01)
*H01Q 1/50* (2006.01)

(52) U.S. Cl. ..... 343/713; 343/906

(58) Field of Classification Search ..... 343/711, 343/713, 904, 905, 906
See application file for complete search history.

(56) References Cited

U.S. PATENT DOCUMENTS 4,843,477 A * 6/1989 Mizutani et al. ..... 348/837

(Continued)

FOREIGN PATENT DOCUMENTS

DE 29500961 U1 6/1995

(Continued)

*Primary Examiner*—HoangAnh T Le
(74) *Attorney, Agent, or Firm*—DeLio & Peterson, LLC; Robert Curcio

(57) ABSTRACT

The invention relates to a motor vehicle roof antenna (100) comprising an antenna housing (110) in which at least two antennae are arranged, wherein a first coaxial connector (114) is allocated to each antenna, and having a connector (200) which comprises a housing (210) and a number of second coaxial connectors (214) corresponding to the number of first coaxial connectors (114), said second coaxial connectors (214) being arranged at a plugging side of the housing (210) at pre-determined positions and with their respective longitudinal axes oriented parallel to a plugging direction of the connector (200), wherein every second coaxial connector (214) is allocated to a first coaxial connector (114) and is configured so as to be insertable into it. Herein, the first coaxial connectors (114) are fastened in a plug interface on the antenna housing (110) and each second coaxial connector (214) is arranged in the housing (210) movable in a plane perpendicular to the plugging direction and is linked via at least one electrically insulated elastic spring element to at least one further second coaxial connector (214) in elastically sprung manner, wherein the elastic spring element (244) is arranged and configured in such a manner that the second coaxial connectors (214) are pre-positioned at the respective pre-determined position, except for tolerance deviations, and can be deflected from this site in the plane perpendicular to the plugging direction in elastically sprung manner.

20 Claims, 10 Drawing Sheets

U.S. PATENT DOCUMENTS

Figure 1A:
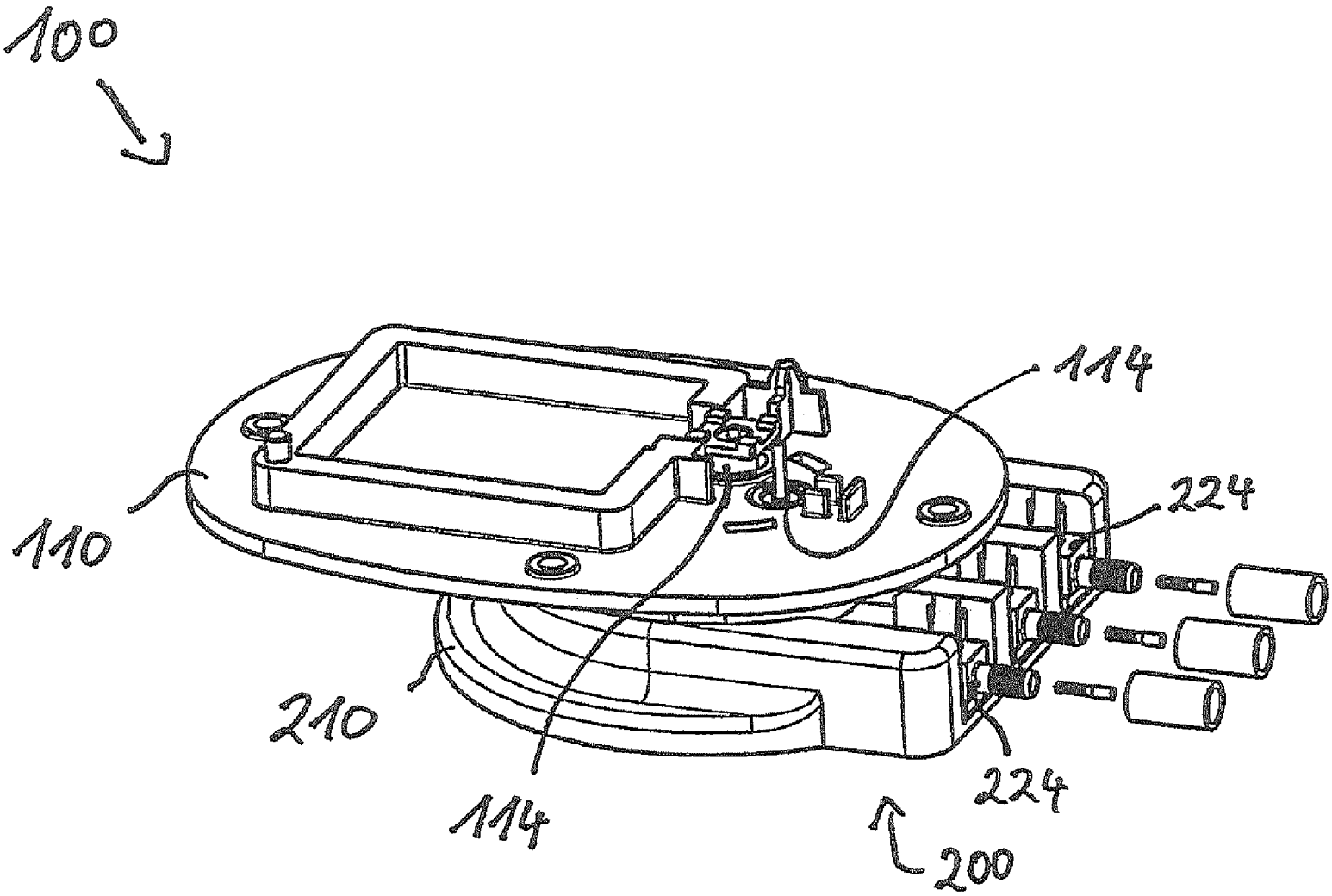

| | | | | |
|---|---|---|---|---|
| 5,641,294 | A | 6/1997 | Beard et al. | |
| 6,980,157 | B2 * | 12/2005 | Nevermann | 343/702 |
| 2006/0009095 | A1 * | 1/2006 | Uraki et al. | 440/47 |
| 2006/0046547 | A1 * | 3/2006 | Matsuo | 439/188 |

FOREIGN PATENT DOCUMENTS

| | | | |
|---|---|---|---|
| DE | 19802265 | A1 | 8/1999 |
| DE | 20 2004 015503 | U1 | 12/2004 |

* cited by examiner

MOTOR VEHICLE ROOF ANTENNA

The invention relates to a motor vehicle roof antenna according to the preamble of claim 1.

In order to make electrical connections from a motor vehicle roof antenna which has a plurality of antennae, for example, a mobile telephone antenna and a GPS antenna to corresponding devices, for example, a mobile telephone unit and a GPS receiver, it is conventional to feed cables out of the housing of the motor vehicle roof antenna, said cables being provided at their free ends with suitable coaxial connectors. Said coaxial connectors are then separately and individually connected to complementary coaxial connectors of cables which continue to the devices. However, this type of electrical connection is complex and costly.

It is an object of the invention to improve a motor vehicle roof antenna of the aforementioned type with regard to its mounting and electrical connection.

This aim is achieved according to the invention with a motor vehicle roof antenna of the aforementioned type having the features characterised in claim 1. Advantageous embodiments of the invention are described in the other claims.

In a motor vehicle roof antenna of the aforementioned type, it is provided according to the invention that the first coaxial connectors are fastened in a plug interface on the antenna housing and that each second coaxial connector is arranged in the housing movable in a plane perpendicular to the plugging direction and is linked via at least one electrically insulated elastic spring element to at least one further second coaxial connector in elastically sprung manner, wherein the elastic spring element is arranged and configured in such a manner that the second coaxial connectors are pre-positioned at the respective pre-determined position, except for tolerance deviations, and can be deflected from this site in the plane perpendicular to the plugging direction in elastically sprung manner.

This has the advantage that the second coaxial connectors are mounted elastically floating. By this means, tolerance-related deviations between the positions of the second coaxial connectors of the connector of the motor vehicle roof antenna and the first coaxial connectors in the antenna housing of the motor vehicle roof antenna are automatically compensated for on inserting the connector into the plug interface of the antenna housing by elastic deflection of the second coaxial connectors of the connector. Therefore, despite tolerance-related deviations of the respective positions, good electrical contact is ensured between the respective second coaxial connectors of the connector and the first coaxial connector of the antenna housing.

In order to provide the most flexible possible tolerance compensation, the second coaxial connectors are arranged movable in the housing in such a manner that the mobility of the second coaxial connectors in the plane perpendicular to the plugging direction includes tilting and/or translational parallel displacement of the longitudinal axes of the second coaxial connectors.

Suitably, each coaxial connector is configured with an inner conductor and an outer conductor.

In order to pass on signals via the connector, each second coaxial connector is linked to a signal conducting element, which electrically connects a second coaxial connector to a connection site for a cable.

For example, each signal conducting element is configured as a coaxial conductor or a flat transmission line and optionally has electrical screening.

In a particularly preferred embodiment, all the signal conducting elements are arranged, starting from the respective second coaxial connector, in one plane extending perpendicularly to the plugging direction, wherein each signal conducting element is configured as a rigid component and has a recess in its housing such that each signal conducting element is movable together with the associated contact element in a plane perpendicular to the plugging direction.

Suitably, every second coaxial connector is surrounded by an electrically insulating sleeve which is connected in elastically sprung manner via an electrically insulating elastic spring element to a sleeve of an adjacent second coaxial connector, wherein, in a cross-sectional plane perpendicular to the plugging direction, the spring elements are formed, for example, Ω-shaped and the sleeves and spring elements are formed in one piece with one another into a sprung housing.

Formed on the housing are first detent means and formed on each spring element are second detent means which, in cooperation with the first detent means, fix the spring elements and with these fix the electrical contact elements to the housing.

In a preferred embodiment, each first detent means comprises an elastically sprung clip which projects from the housing in the plugging direction and has a recess, wherein every second detent means comprises a detent lug which extends from the respective spring element perpendicularly to the plugging direction and fits into the recess of the sprung clip of the first detent means.

Mechanical coding which prevents incorrect insertion of the connector according to the invention is thereby made available that at least one of the clips of the first detent means of the housing has a different width from the other clips.

In order to hold the connector in the inserted condition, at least two, and particularly three, mutually spaced detent pegs each having a detent lug, project from the housing in the plugging direction, said detent pegs being configured for locking into the antenna housing.

Figure 1B:
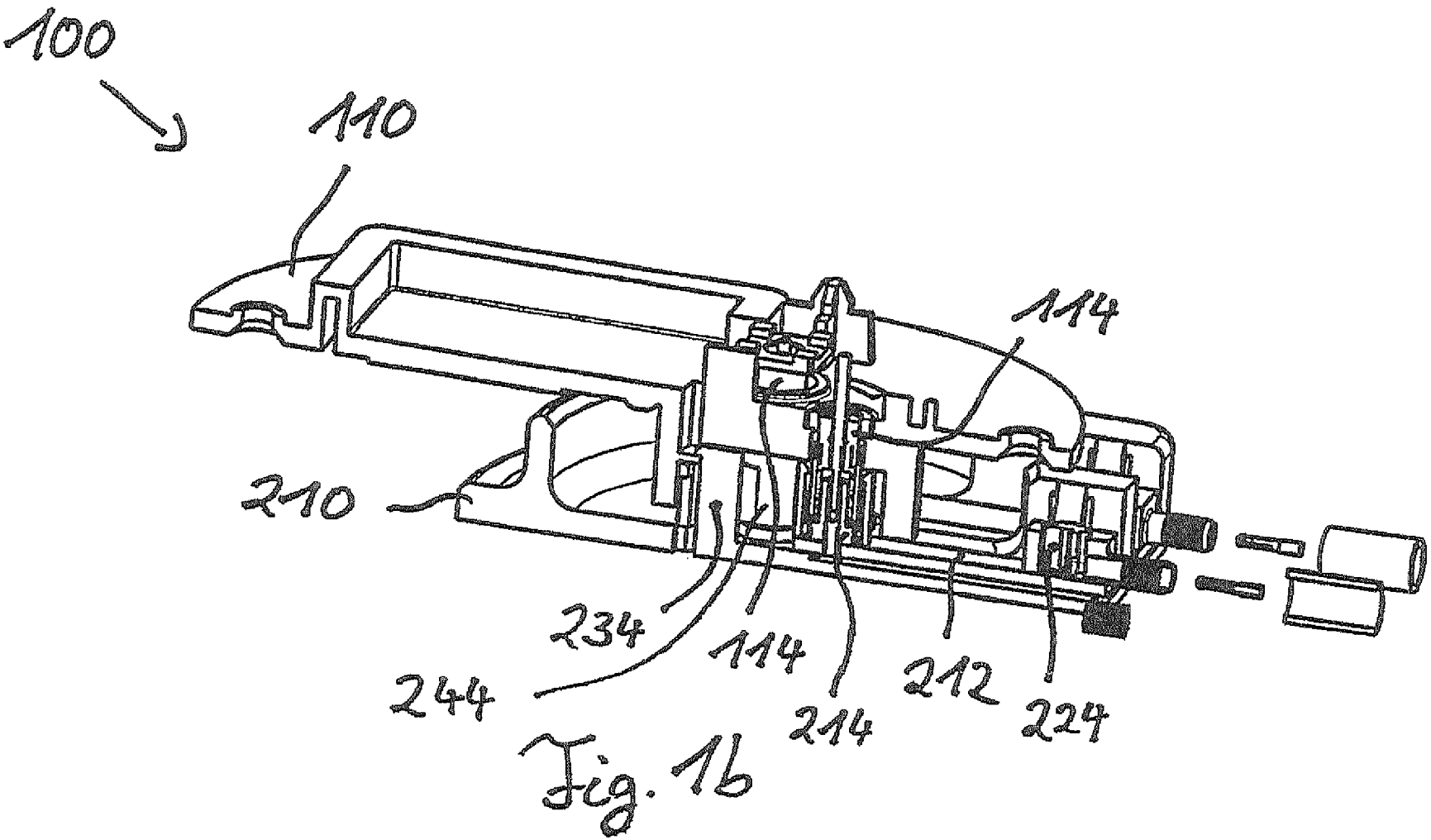
Figure 2:
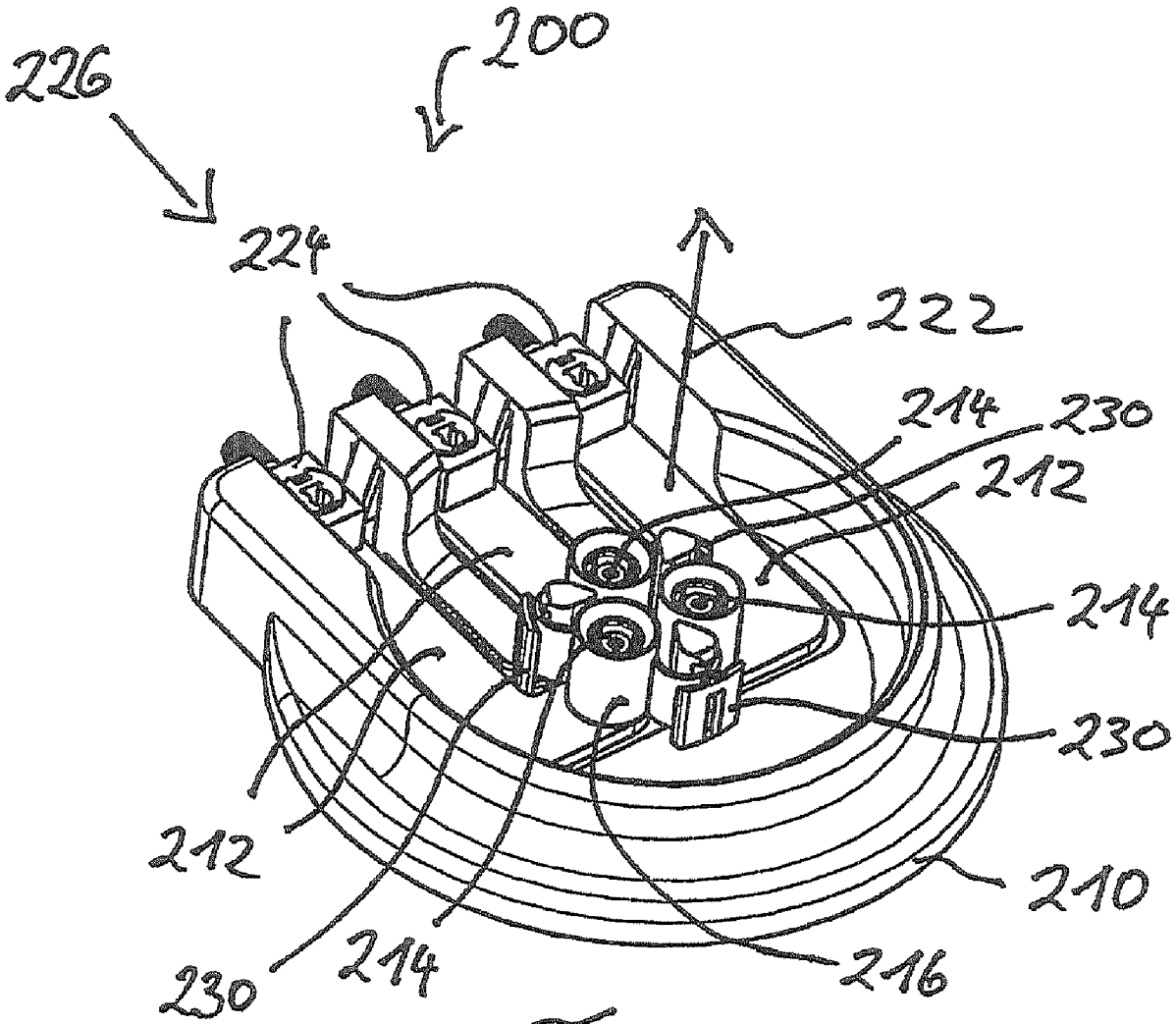
Figure 3:
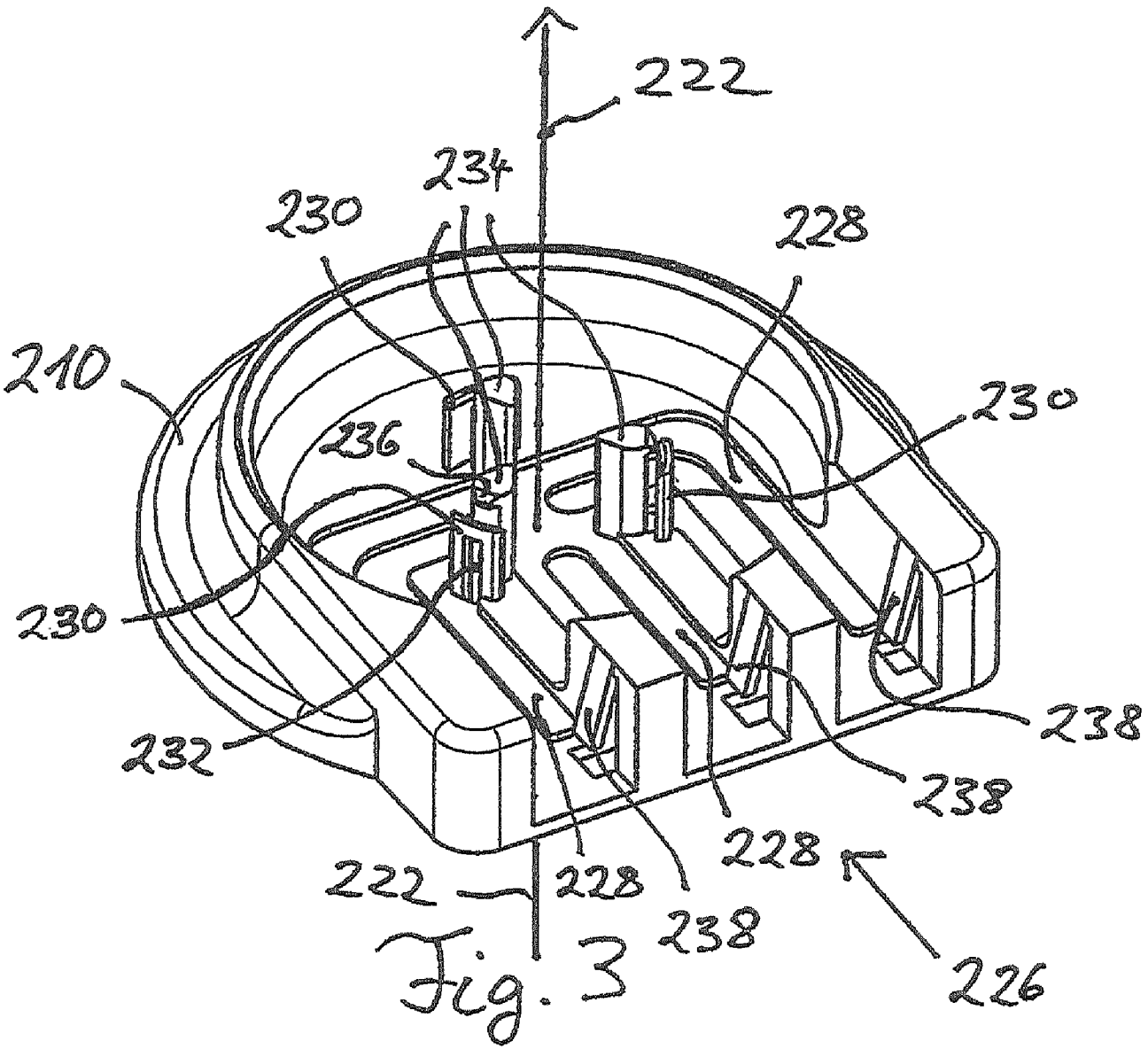
Figure 4:
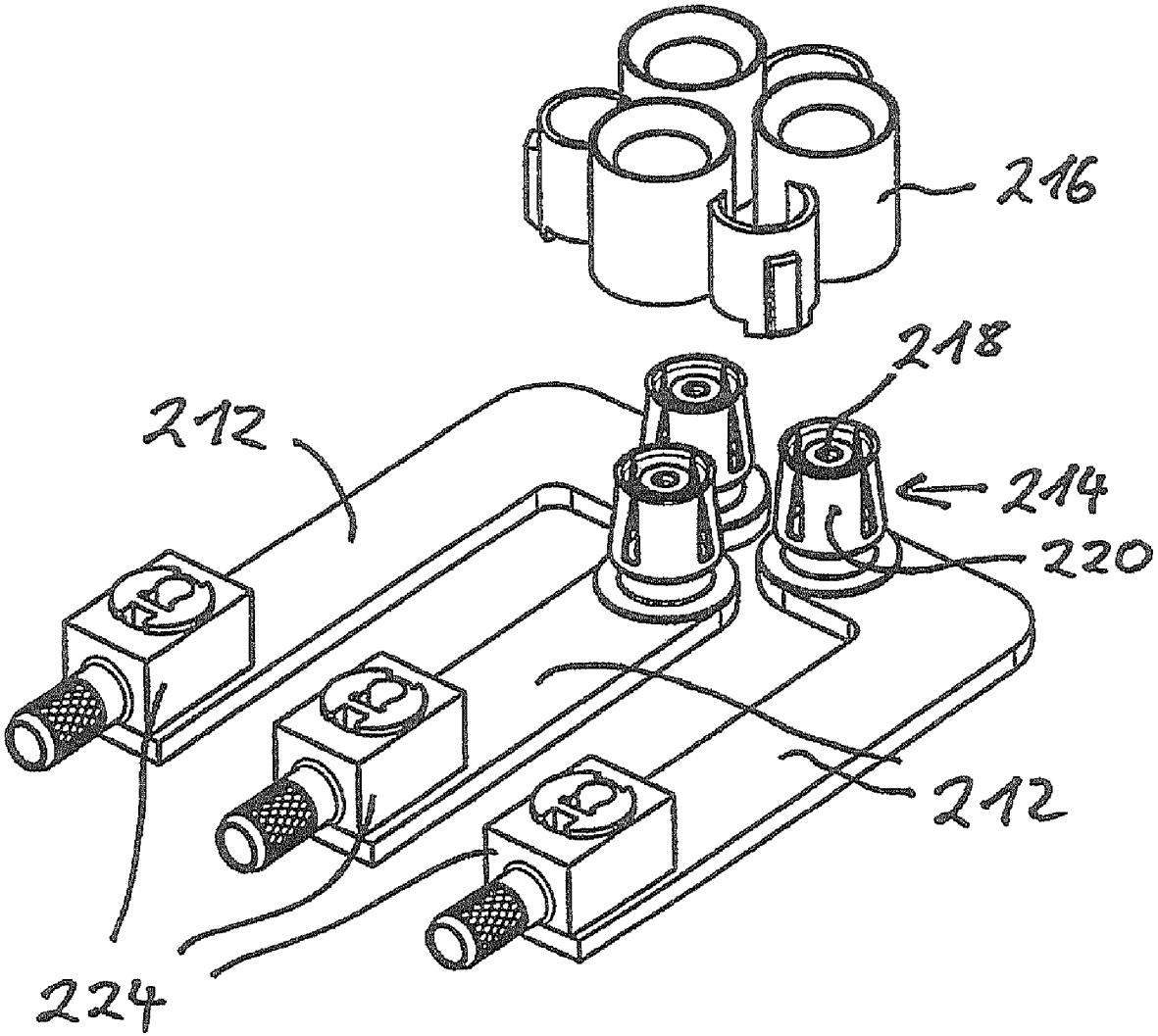
Figure 5:
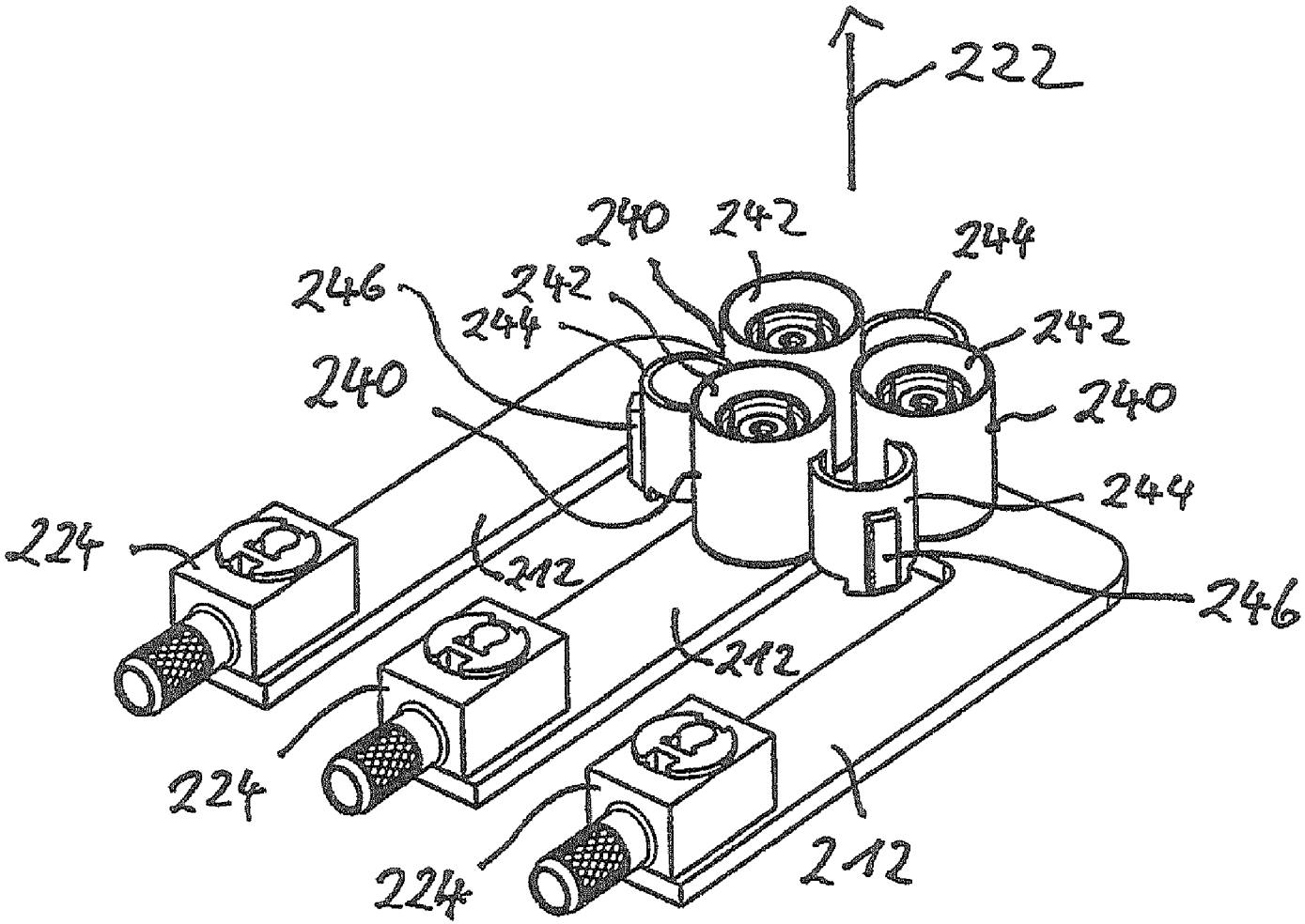
Figure 6:
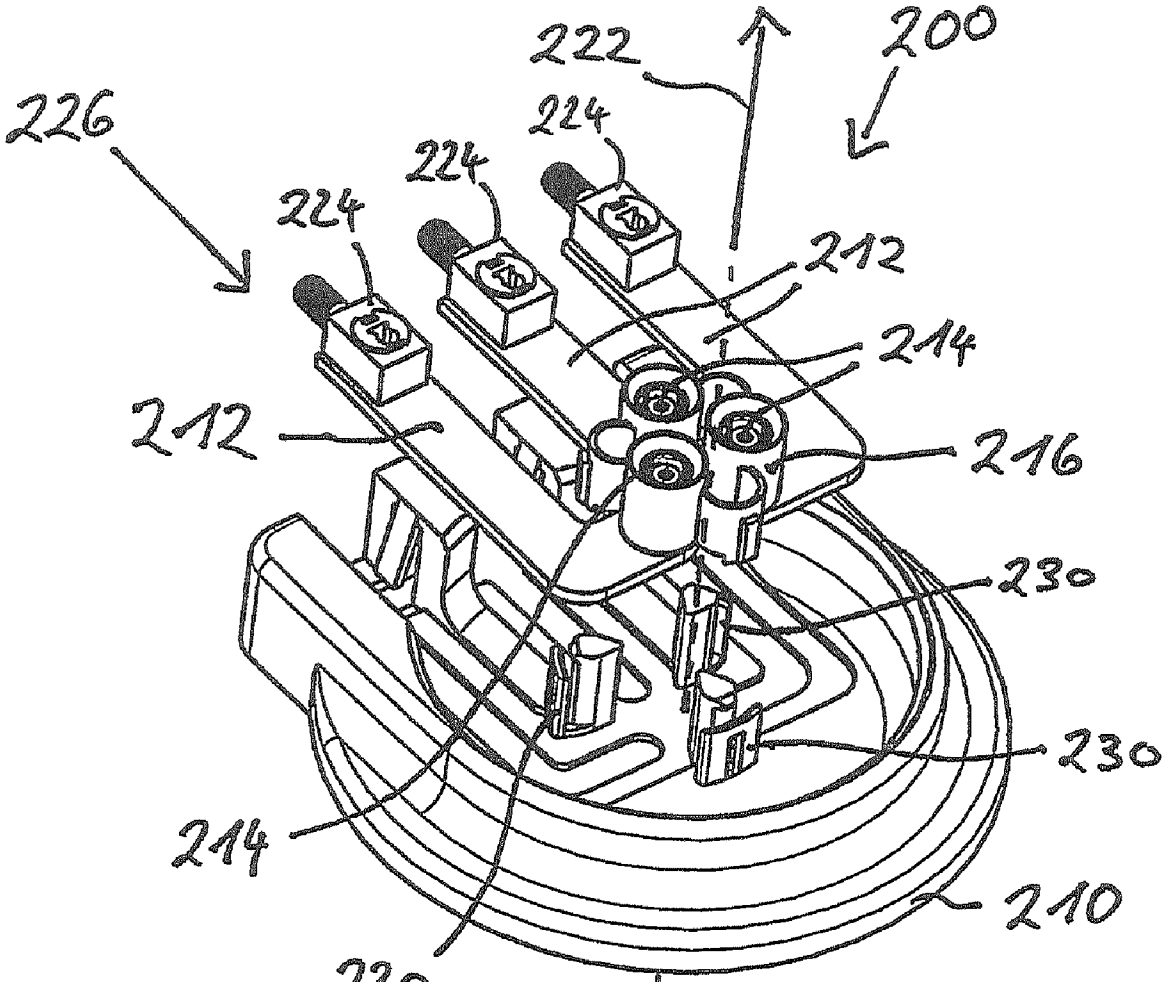
Figure 7:
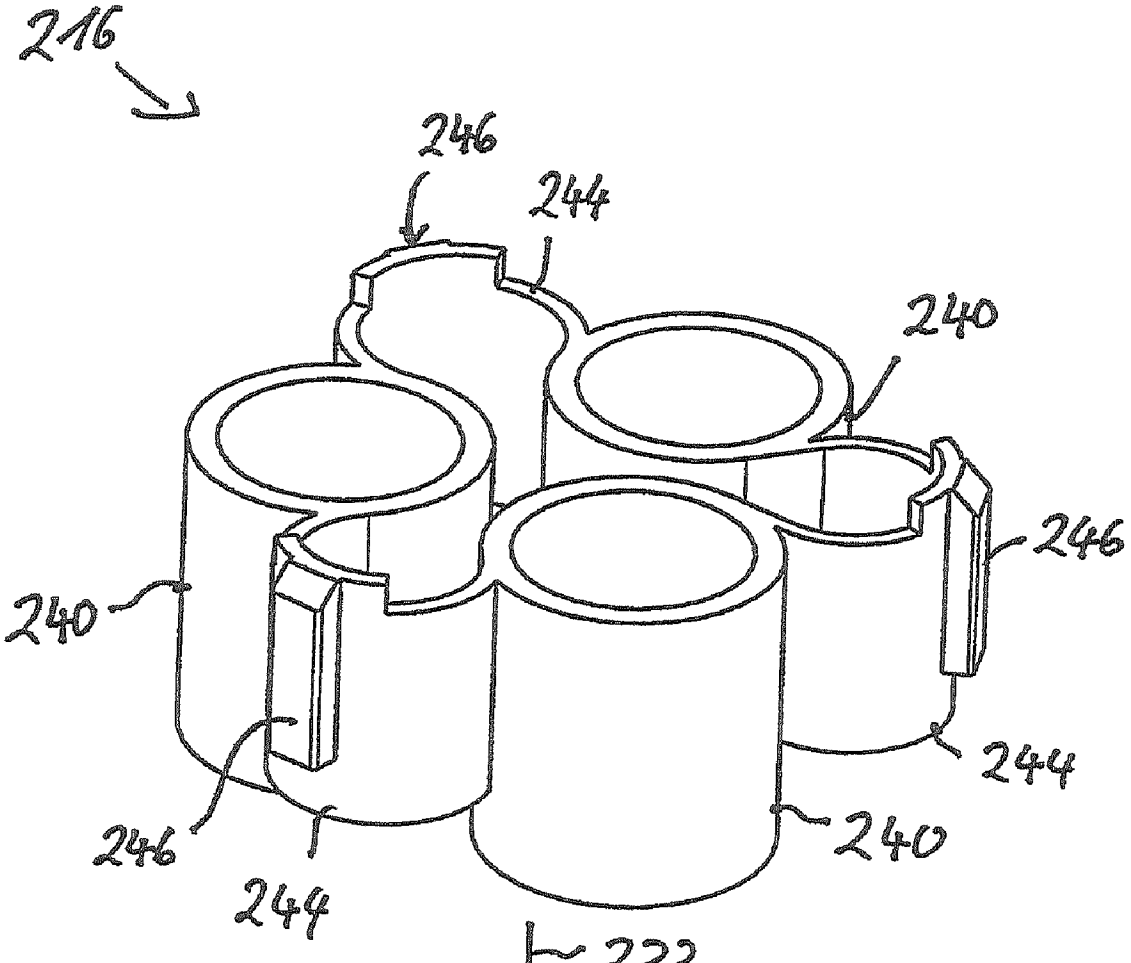
Figure 8:
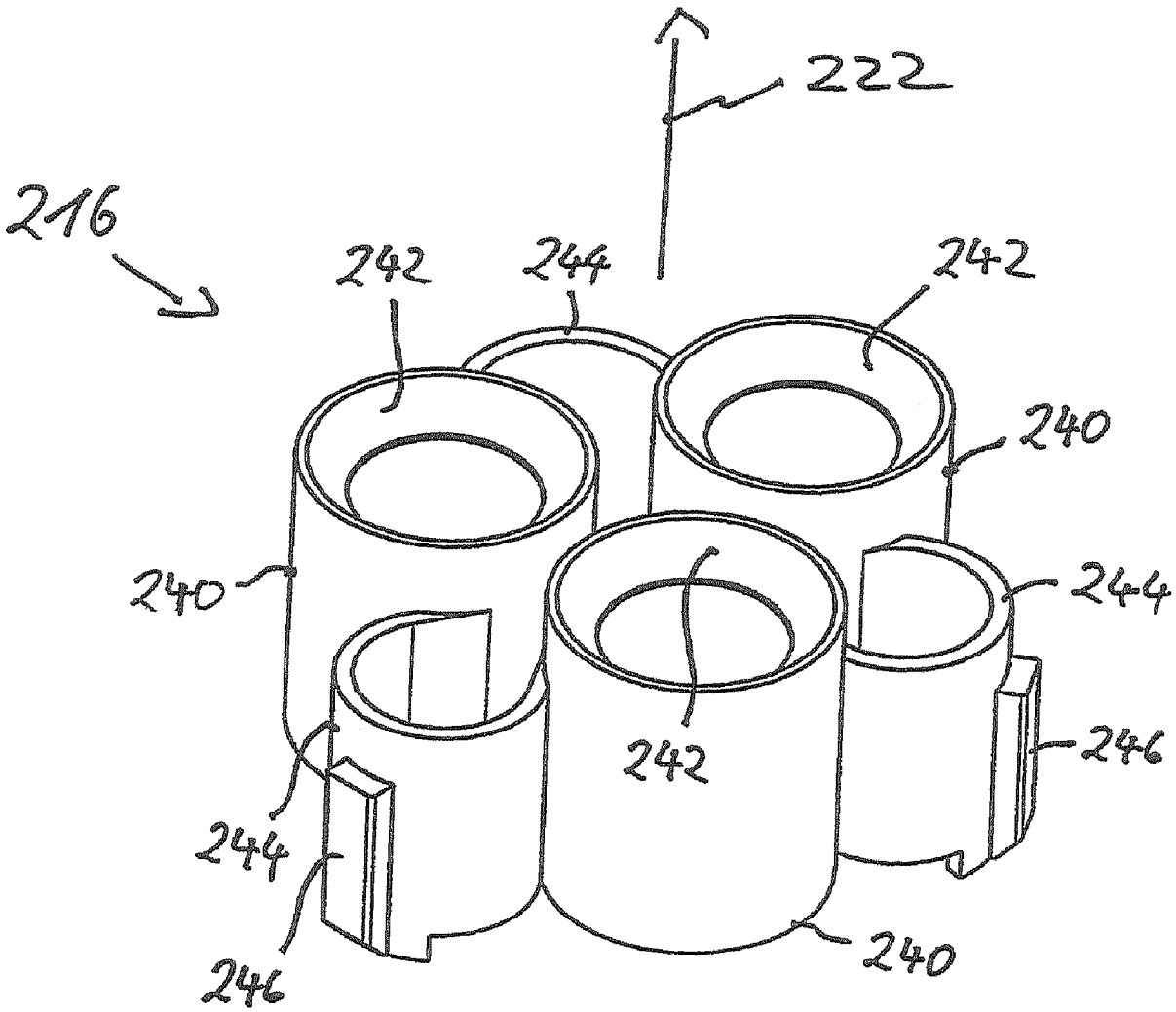
Figure 9:
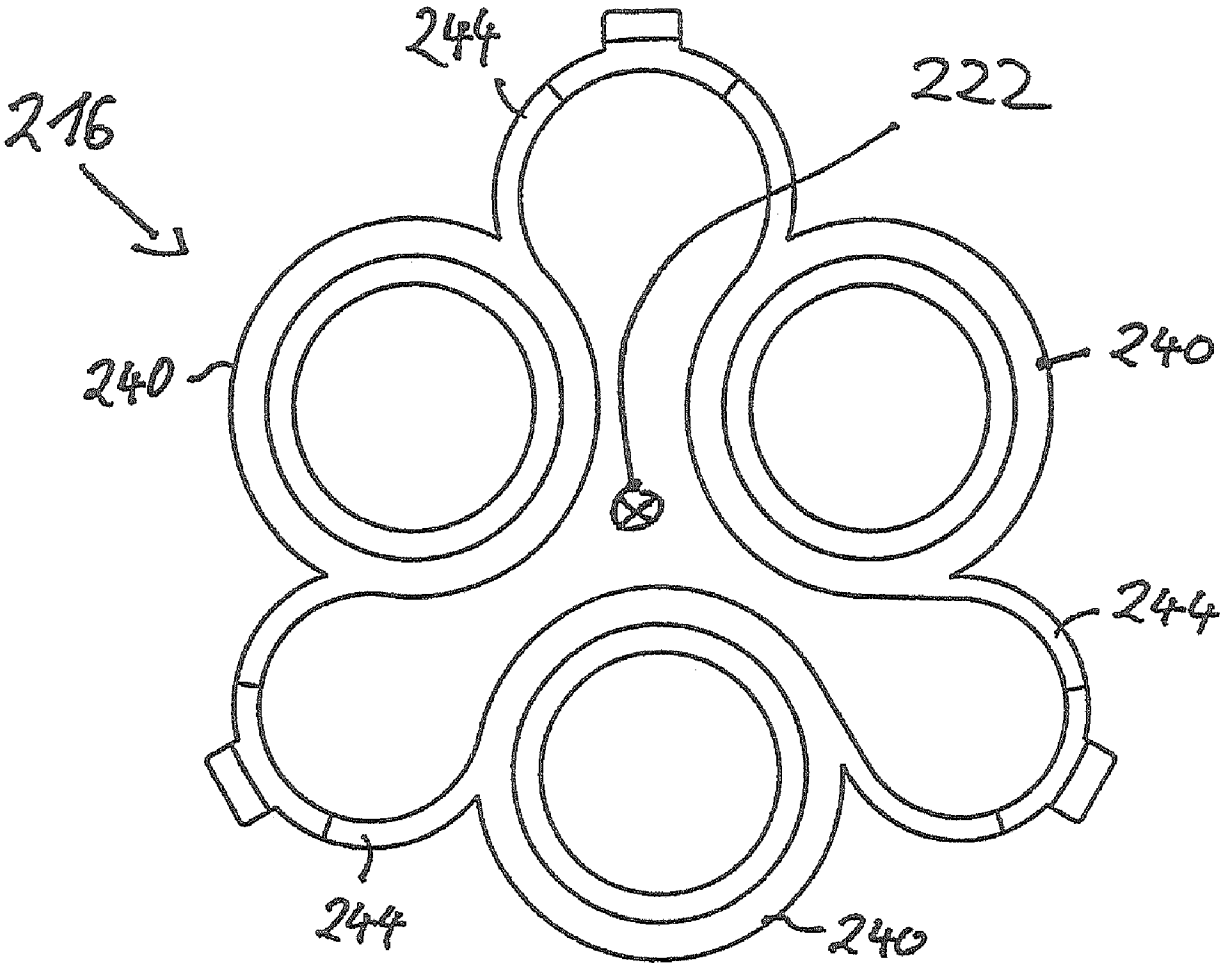

The invention will now be described in greater detail by reference to the drawings, in which:

FIG. 1*a* shows a preferred embodiment of a motor vehicle roof antenna according to the invention in a perspective view, and FIG. 1*b* in a side view, FIG. 2 shows a connector of the motor vehicle roof antenna in a perspective view, FIG. 3 shows a housing of the connector in a perspective view, FIG. 4 shows contact elements, signal conductor elements and sprung housing in an exploded view, and FIG. 5 in a perspective view in the assembled state, FIG. 6 shows the connector of FIG. 2 in the partially assembled state in a perspective view, FIG. 7 shows the sprung housing of the connector of FIG. 2 in a perspective view from beneath, and FIG. 8 from above, and FIG. 9 in plan view.

The motor vehicle antenna 100 shown in FIGS. 1*a* and 1*b* comprises an antenna housing 110 whose cover is not shown for the sake of simplicity and clarity, and a connector 200. Fastened to the antenna housing 110 are a mobile telephone antenna (not shown) and a GPS antenna (not shown). For each of the antennae, a first coaxial connector 114 is provided in a plug interface of the antenna housing 110, wherein the coaxial connector 114 is rigidly attached to the antenna housing 110. Its target position is defined by a target dimension, although tolerance-related deviations from this target position exist. The connector 200 serves to connect the antennae electrically through a motor vehicle roof to corresponding devices, which in this example are a mobile telephone unit and a GPS receiver, wherein the antenna housing 110 is situated externally on the roof and the connector 200 is situated internally in a passenger cabin of the motor vehicle.

The connector 200 shown in FIGS. 1*a* to 2 and 6 comprises a housing 210, three signal conducting elements 212, three second coaxial connectors 214 and a sprung housing 216. The arrow 222 indicates a plugging direction in which the connector 200 is insertable into the plug interface of the antenna housing 110. This plugging direction 222 lies in this example substantially perpendicular to a plane defined by the housing 210, so that the connector in question is an angle connector. This allows a small structural depth within the passenger cabin of the motor vehicle. The first and second coaxial connectors 114, 214 are inserted into one another when the connector 200 is inserted into the connector interface on the antenna housing 110. By this means, the first and second coaxial connectors 114, 214 form an electrical contact through the motor vehicle roof and electrically connect the antennae to the cables which lead to the devices.

As is shown in particular in FIG. 4, the coaxial connectors are configured with an inner conductor 218 and an outer conductor 220. The signal conducting elements 212 are each configured as flat transmission lines which extend in a plane perpendicular to the plugging direction 222 and each connect a coaxial connector 214 to a cable connection 224 on a cable-side end 226 of the connector 200. For example, the flat transmission lines 212 are formed with three conductor tracks stacked in sandwich-like manner upon one another, wherein the central conductor track transmits the electrical RF signal coming from the antennae and the two outer tracks are connected to earth for electrical screening of the signal line.

As FIG. 3 in particular shows, the housing comprises recesses 228 for accommodating one of the flat transmission lines 212 each. These recesses 228 are dimensioned such that the flat transmission lines 212 can move in a plane perpendicular to the plugging direction 222. First detent means 230 in the form of elastically sprung clips, each having a recess 232 extend from a base of the housing 200. Detent pegs 234, each having detent lugs 236 also extend from the base of the housing 200, said detent lugs 236 being formed for locking into the plug interface or the antenna housing 210, in order to connect the housing 200 mechanically to the antenna housing 210. Also formed on the cable-side end 226 of the housing 210 are elastically sprung detent clips 238 which are provided for fastening the flat transmission lines 212 to the housing 210 on the cable-side end 226, as is clear in particular from FIG. 2.

The sprung housing 216 which is visible in detail from FIGS. 5 and 7 to 9 comprises three sleeves 240 made of electrically insulating material, each of which surrounds one of the second coaxial connectors 214. The sleeves 240 are each provided on a side facing towards the plugging direction 222 on their periphery with a bevel 242, which serve as a capture region for the first coaxial connector 114 in the plug interface of the antenna housing 110 on inserting the connector 200 into the plug interface. The sleeves 240 are connected to one another via elastic spring elements 244 such that, together with the spring elements, they form the sprung sleeve 216 which, on the one hand, holds the second coaxial connector 214 at a pre-determined position in accordance with the target dimension (target position) and, on the other hand, allows elastic deflection of the sleeves 240 and thus of the second coaxial connectors 214 relative to one another, so that the second coaxial connectors 214 can adapt to tolerance-related deviations of the position of the first coaxial connectors 114 which are rigidly arranged in the plug interface of the antenna housing 110 from their target positions through suitable movements away from the target position according to the target dimension. In other words, the plug connector 200 enables simultaneous insertion of the second separate coaxial connectors 214 into the first coaxial connectors 114 without excessively high tolerance demands having to be placed on the positioning of the first coaxial connectors 114 as regards their arrangement in the plug interface of the antenna housing 110. This saves costs and manufacturing effort through lower tolerance requirements, or larger permissible tolerance deviations from the target dimension or the target position of the second coaxial connector 214 and the first coaxial connector 114. The sleeves 240 and the spring elements 244 comprise the sprung housing 216 and are formed in one piece with one another.

The spring elements 244 which connect the sleeves 240 in elastically sprung manner are formed substantially Ω-shaped in cross-section perpendicular to the plugging direction 222 and have second detent means 246 on their outside in the form of detent lugs which fit into the recesses 232 of the clips 230. By means of this arrangement, the second coaxial connectors 214 can be deflected out of the target position in the plane perpendicular to the plugging direction 222 in elastically sprung manner, whilst they are fixed along the plugging direction 222.

On assembly of the connector 200, initially the sprung housing 216 is pushed over the second coaxial connector 214 so that each sleeve 240 accommodates one of the second coaxial connectors 214, as illustrated in FIGS. 4 and 5. The flat transmission lines 212 are then pushed into the recesses 228 in the housing 210 against the plugging direction 222 until the detent clips 238 of the housing 210 lock over the flat transmission lines 212 and the detent lugs 246 of the spring elements 244 of the sprung housing 216 lock into the recesses 232 of the clips 230, whereby the respective arrangements of second coaxial connectors 214, flat transmission line 212 and cable connection 224, on the one hand, are connected to the housing 210 while, on the other hand, the second coaxial connectors 214 can move relative to one another, in the order of magnitude of tolerance deviations, away from the target position due to the floating movement of the flat transmission lines 212 in the recesses 228 and the elastic spring effect of the spring elements 244 in the plane perpendicular to the plugging direction 222.

As can be seen in particular from FIGS. 2 and 6, the clips 230 have varying widths. By means of corresponding recesses in the plug interface of the antenna housing 110, a mechanical coding is made available which prevents incorrectly oriented insertion of the connector 200 into the plug interface of the antenna housing 110. It is thereby ensured that the correct second coaxial connector 214 of the connector 200 always meets the correct first coaxial connector 114 in the plug interface of the antenna housing 110.

The electrical connection between the antenna and the respective terminal device, in this example a mobile telephone and a GPS receiver, takes place directly via insertion of the connector 200 into the plug interface of the motor vehicle roof antenna 100. Herein, the respective coaxial connectors for the mobile telephone antenna and the GPS antenna are simultaneously plugged together. An additional cable connection can be dispensed with. The first coaxial connectors 114 are each connected directly to the associated antenna. Apart from an improvement in the signal transmission as a result of having fewer contact sites in the signal path, installation is also simplified, since the respective pairs of first and second coaxial connectors 114, 214 for the various antennae do not have to be plugged together separately.

The invention claimed is:

1. A motor vehicle roof antenna comprising an antenna housing and having at least two antennae arranged, wherein a first coaxial connector is allocated to each antenna, and having a connector which comprises a housing and a number of second coaxial connectors corresponding to said first coaxial connectors, said second coaxial connectors being arranged at a plugging side of the housing at pre-determined positions and with their respective longitudinal axes oriented parallel to a plugging direction of the connector, wherein every second coaxial connector is allocated to a first coaxial connector and is configured so as to be insertable therein, such that the first coaxial connectors are fastened in a plug interface on the antenna housing and each second coaxial connector is arranged in the housing movable in a plane perpendicular to the plugging direction and is linked via at least one electrically insulated elastic spring element to at least one further second coaxial connector in elastically sprung manner, wherein the elastic spring element is arranged and configured such that the second coaxial connectors are pre-positioned at the respective pre-determined position, except for tolerance deviations, and can be deflected from this site in the plane perpendicular to the plugging direction in elastically sprung manner.

2. The motor vehicle roof antenna of claim 1 including having the second coaxial connectors arranged movable in the housing such that the mobility of the second coaxial connectors in the plane perpendicular to the plugging direction includes tilting, or translational parallel displacement, or a combination of both movements, of the longitudinal axes of the second coaxial connectors.

3. The motor vehicle roof antenna of claim 2 including having each coaxial connector configured with an inner conductor and an outer conductor.

4. The motor vehicle roof antenna of claim 2 including having each second coaxial connector linked to a signal conducting element, which electrically connects said second coaxial connector to a connection site for a cable.

5. The motor vehicle roof antenna of claim 4 including having each signal conducting element configured as a coaxial conductor or a flat transmission line.

6. The motor vehicle roof antenna of claim 4, wherein each signal conducting element is configured with electrical screening.

7. The motor vehicle roof antenna of claim 4 including having all the signal conducting elements arranged, starting from the respective second coaxial connector in one plane extending perpendicularly to the plugging direction.

8. The motor vehicle roof antenna of claim 4 including having each signal conducting element configured as a rigid component and having a recess in its housing such that each signal conducting element is movable together with an associated contact element in a plane perpendicular to the plugging direction.

9. The motor vehicle roof antenna of claim 1 including having every second coaxial connector surrounded by an electrically insulating sleeve which is connected in elastically sprung manner via an electrically insulating elastic spring element to a sleeve of an adjacent second coaxial connector.

10. The motor vehicle roof antenna of claim 9 wherein the spring elements are formed Ω-shaped in a cross-sectional plane perpendicular to the plugging direction.

11. The motor vehicle roof antenna of claim 9 including having the sleeves and spring elements formed in one piece with one another into a sprung housing.

12. The motor vehicle roof antenna of claim 1 including having a first detent formed on the housing and a second detent formed on each spring element which, in cooperation with the first detent, fix the spring elements to the housing.

13. The motor vehicle roof antenna of claim 12 including having each first detent comprising an elastically sprung clip which projects from the housing in the plugging direction and a recess, wherein every second detent comprises a detent lug which extends from the respective spring element perpendicularly to the plugging direction and fits into the recess of the sprung clip of the first detent.

14. The motor vehicle roof antenna of claim 13 including at least one of the clips of the first detent of the housing having a different width from the other clips.

15. The motor vehicle roof antenna of claim 12 including having at least two mutually spaced detent pegs each having a detent lug project from the housing in the plugging direction, said detent pegs being configured for locking into the antenna housing.

16. The motor vehicle roof antenna of claim 7 including having each signal conducting element configured as a rigid component and having a recess in its housing such that each signal conducting element is movable together with an associated contact element in a plane perpendicular to the plugging direction.

17. The motor vehicle roof antenna according to claim 2 including having every second coaxial connector surrounded by an electrically insulating sleeve which is connected in elastically sprung manner via an electrically insulating elastic spring element to a sleeve of an adjacent second coaxial connector.

18. The motor vehicle roof antenna of claim 9 including having a first detent formed on the housing and a second detent formed on each spring element which, in cooperation with the first detent, fix the spring elements to the housing.

19. The motor vehicle roof antenna of claim 18 including having each first detent comprising an elastically sprung clip which projects from the housing in the plugging direction and a recess, wherein every second detent comprises a detent lug which extends from the respective spring element perpendicularly to the plugging direction and fits into the recess of the sprung clip of the first detent.

20. The motor vehicle roof antenna of claim 18 including having at least two mutually spaced detent pegs each having a detent lug project from the housing in the plugging direction, said detent pegs being configured for locking into the antenna housing.

* * * * *